US007864290B2

(12) United States Patent
Baker

(10) Patent No.: US 7,864,290 B2
(45) Date of Patent: Jan. 4, 2011

(54) FILM SECURITY CODE

(75) Inventor: David Frederick Baker, West Drayton (GB)

(73) Assignee: Thomson Licensing, Boulogne-Billancourt (FR)

( * ) Notice: Subject to any disclaimer, the term of this patent is extended or adjusted under 35 U.S.C. 154(b) by 566 days.

(21) Appl. No.: 11/922,648

(22) PCT Filed: Jan. 31, 2006

(86) PCT No.: PCT/US2006/003533

§ 371 (c)(1),
(2), (4) Date: Dec. 20, 2007

(87) PCT Pub. No.: WO2007/005059

PCT Pub. Date: Jan. 11, 2007

(65) Prior Publication Data

US 2009/0244487 A1 Oct. 1, 2009

Related U.S. Application Data

(60) Provisional application No. 60/695,092, filed on Jun. 29, 2005.

(51) Int. Cl.
*G03C 5/26* (2006.01)
*G03C 7/30* (2006.01)

(52) U.S. Cl. ..... 352/52; 430/10; 430/428; 396/604

(58) Field of Classification Search ..... 352/52, 352/232, 244; 427/407.1, 412.1, 331, 372.2; 396/604–611; 430/10, 13, 428
See application file for complete search history.

(56) References Cited

U.S. PATENT DOCUMENTS

| | | | | |
|---|---|---|---|---|
| 3,756,707 | A | 9/1973 | Sharp | |
| 6,450,644 | B1 | 9/2002 | Goodhill et al. | |
| 6,767,681 | B2 * | 7/2004 | Fyson | 430/30 |
| 2010/0110411 | A1 * | 5/2010 | Olson et al. | 355/77 |

OTHER PUBLICATIONS

Search Report Dated Oct. 16, 2006.

* cited by examiner

*Primary Examiner*—William C Dowling
(74) *Attorney, Agent, or Firm*—Robert D. Shedd; Robert E. Levy; Jeffrey D. Hale

(57) ABSTRACT

A system and method for coding an intermediate film element, e.g., an interpositive or an internegative, in an effective manner while maintaining the integrity of the film element. A first coat of a stabilizer is applied to frames of a selected scene. A second coat of stabilizer is applied, and a third coat of stabilizer is thereafter applied. A security code according to the present invention may be applied to specifically selected locations on a reel or footage so as to create a unique code which is traceable to, e.g., a specific laboratory.

19 Claims, 2 Drawing Sheets

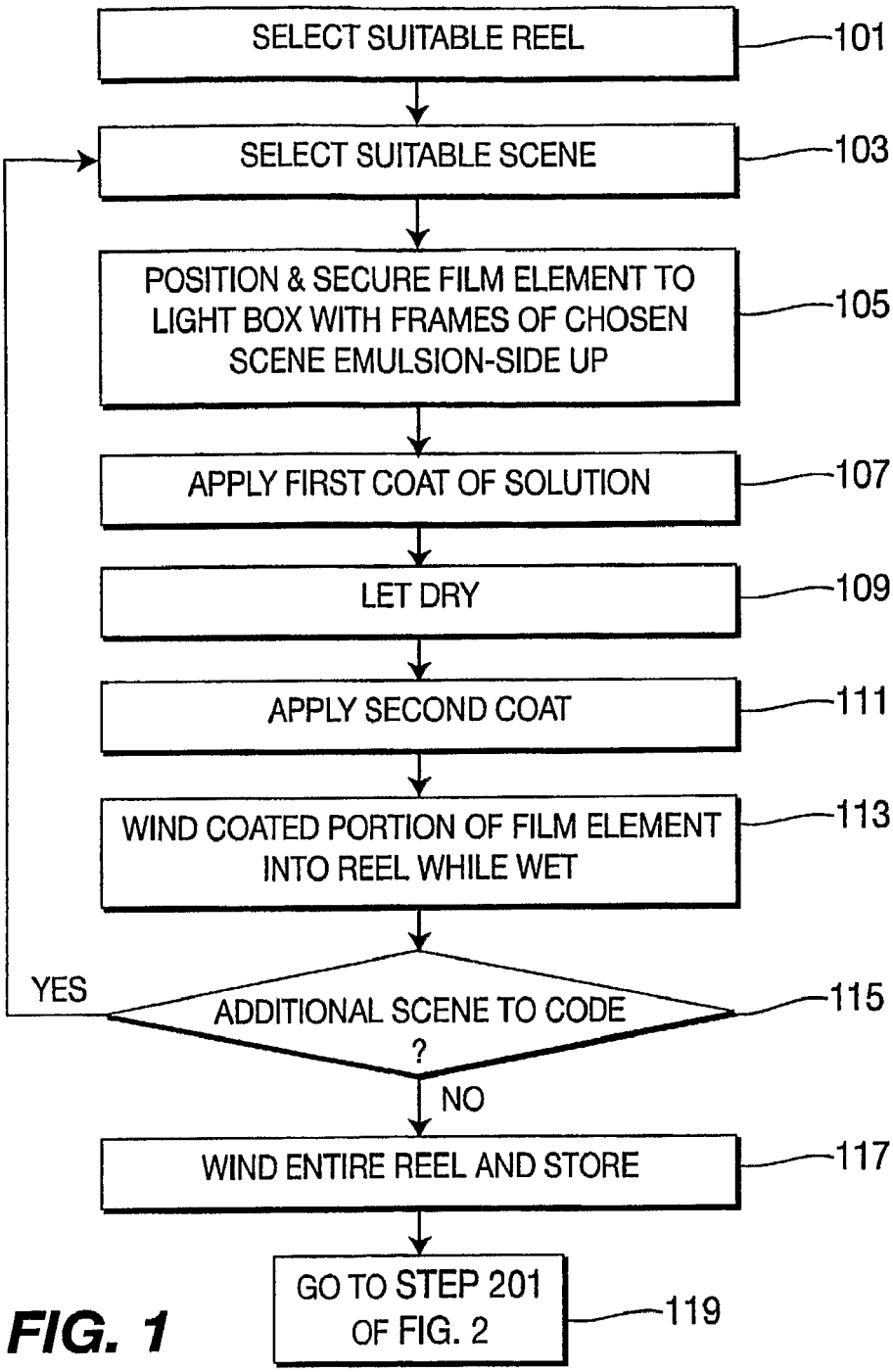
FIG. 1
FIG. 3
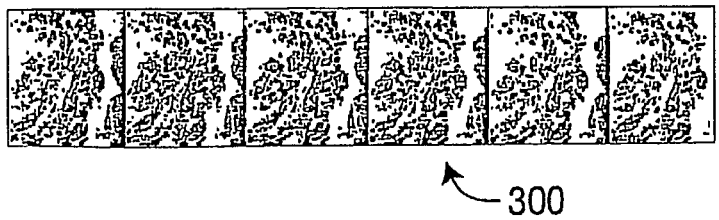

FILM SECURITY CODE

CROSS-REFERENCE TO RELATED APPLICATIONS

This application claims the benefit, under 35 U.S.C. §365 of International Application PCT/US2006/003533, filed Jan. 31, 2006, which was published in accordance with PCT Article 21(2) on Jan. 11, 2007 in English and which claims the benefit of U.S. provisional patent application No. 60/695,092, filed Jun. 29, 2005.

TECHNICAL FIELD OF THE INVENTION

The present invention generally relates to anti-piracy film security and, more particularly, to a system and method for marking a film negative with a security code.

BACKGROUND OF THE INVENTION

Typically, when a film is produced, duplicate negatives are also created from the original negative. One method of negative duplication involves producing an interpositive element, in which the original negative is contact-printed onto film to produce a positive image on film (an interpositive). The interpositive is then contact-printed onto film to produce the duplicate negative (internegative). This process provides the most accurate tone reproductions possible, and results in two duplicates for relatively little additional cost. The two copies produced are the interpositive, which becomes the master, and the internegative, which becomes the use copy.

However, the production of these intermediate film elements (interpositive and internegative) further makes possible their unauthorized or unwanted reproduction. Such elements may be copied illicitly, in violation of the proprietors' copyrights, and it is often difficult for proprietors to tracks the uses to which their film is put.

Accordingly, an efficient and effective method for detecting and tracing unauthorized copying of a film element would be highly desirable.

SUMMARY

The present invention provides a system and method for marking an intermediate film element (e.g., interpositive or internegative) so as to render any print processed from such film element traceable. This is accomplished by placing a 'soft' (i.e., blending in with the photographic elements so as to not stand out strongly in the photography) but indelible mark or marks onto a negative at a specific location. Thus, the print struck from the marked negative can be traced if pirated. Advantageously, the present invention facilitates tracing of illegal copies made from a negative through pirated DVD's videos, etc.

In one aspect, a method of coding a film element is provided comprising the steps of applying a first coat of a stabilizer solution to frames of a selected scene of a selected reel of the film element to form single coated frames, applying a second coat of the stabilizer solution to the single-coated frames to form double coated frames, and applying a third coat of the stabilizer solution to the double-coated frames.

In another aspect, the present invention provides a method of coding a film element comprising the steps of selecting a suitable reel of the film element to be coded, selecting a suitable and desired location in said selected reel to be coded and applying a first coat of a stabilizer solution to frames of the selected location. A second coat of the stabilizer solution is applied to the frames. A third coat of the stabilizer solution is applied to the frames.

These, and other aspects, features and advantages of the present invention will be described or become apparent from the following detailed description of the preferred embodiments, which is to be read in connection with the accompanying drawings.

BRIEF DESCRIPTION OF THE DRAWINGS

In the drawings, wherein like reference numerals denote similar elements throughout the views:

FIG. 1 is a flow diagram of an exemplary method for coding an intermediate film element according to an aspect of the present invention.

FIG. 3 is an exemplary depiction of a print made from a coded negative according to an aspect of the present invention.

Figure 2:
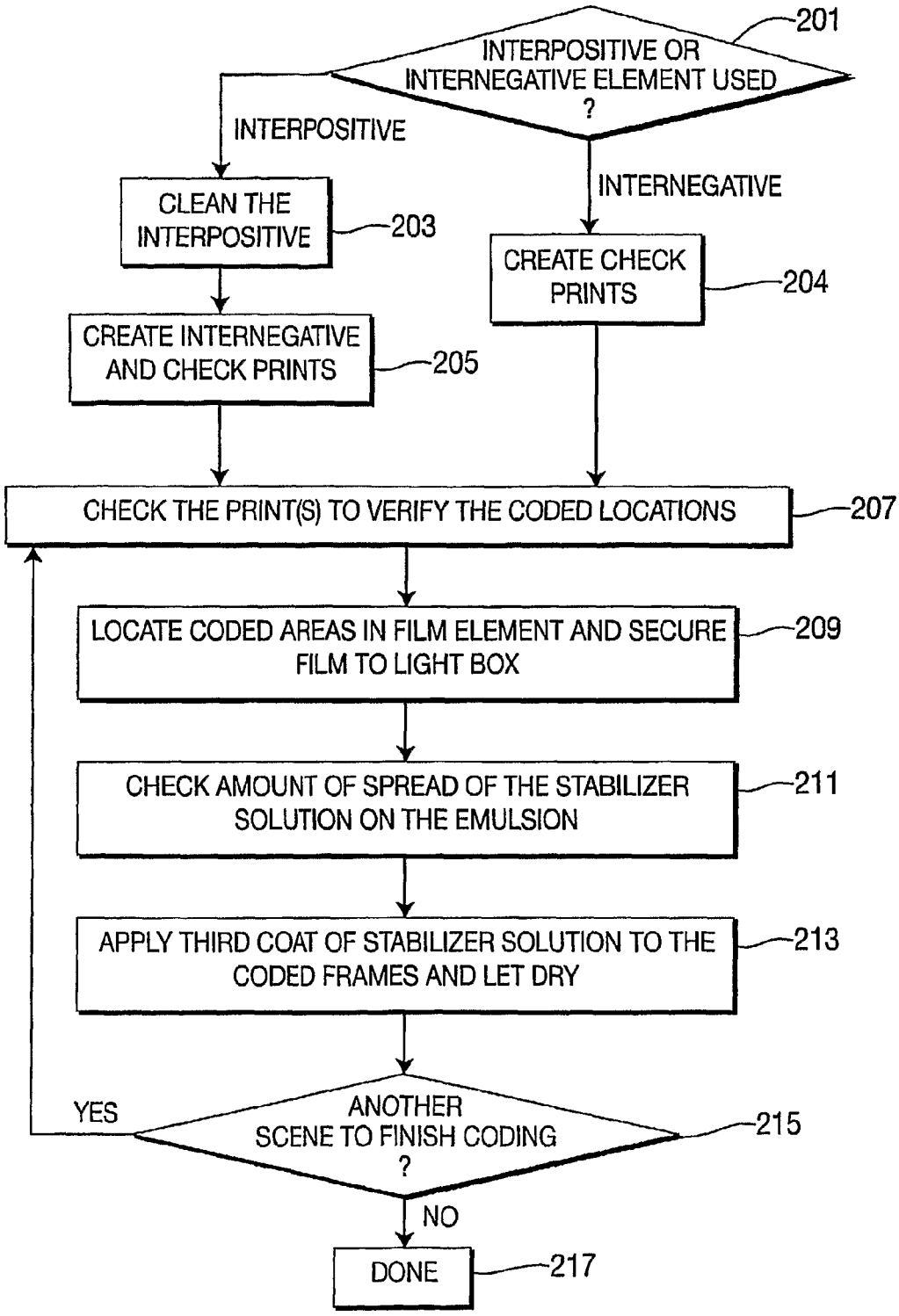
FIG. 2 is a continuation of the flow diagram of FIG. 1.

It should be understood that the drawing(s) is for purposes of illustrating the concepts of the invention and is not necessarily the only possible configuration for illustrating the invention.

DETAILED DESCRIPTION OF PREFERRED EMBODIMENTS

The present invention provides a system and method for coding an intermediate film element (e.g., an interpositive or an internegative) in an effective manner with no damage to the film element. A security code according to the present invention may be applied to specific locations on a reel or footage so as to create a unique code which is traceable to, e.g., a specific laboratory. Advantageously, while the code (marking) is virtually imperceptible e.g., to an audience during playback of the film via a projector, the applied code is durable and resistant to tampering or removal and will survive, e.g., any compressions related to the creation of pirated digital or video recordings.

FIG. 1 is a flowchart of an exemplary method for coding an intermediate film element according to an aspect of the present invention. In step 101, a suitable reel is identified for application of a code (security marking) according to the present invention. The present invention is particularly designed for use with conventional film elements such as intermediate negatives and digital negatives. In accordance with an aspect of the present invention, it is noted that a code or mark is preferably applied to an intermediate film element such as an interpositive or an internegative.

Preferably, an interpositive is used for security coding according to a preferred embodiment of the present invention. A security code applied to an interpositive according to the present invention will appear similar to, e.g., a watermark streak, while a code applied to an internegative according to the present invention will appear as, e.g., a light density change or slight color drop to the non-trackside of the film. (A non-trackside is defined as the opposite side of the film to where the sound track (area on the negative reserved for the sound) is located.

The selection of a suitable reel preferably involves consideration of at least the following criteria:

1. Do not use a reel that is designated for security code application onto its print(s) (e.g., a reel designated for a conventional Technicolor™ Security Code process, in which a code is applied to the print).

2. Do not use a reel that is likely to be re-cut.

3. Do not use any reel that will have titles (e.g., the first and last reel of a film).

4. The code should be applied within a single scene (the code should not run from one scene to the next). That is, it is desirable to have the code stopped at an end or beginning of a scene so as for the code to appear as part of the photography and thus be minimally intrusive.

Next, a specific location in the reel is selected for coding. This involves, e.g., selecting a suitable and desired scene in the reel for applying a code (step 103). For example, 2 to 4 scenes may be selected in one reel. A suitable scene may be defined as satisfying certain criteria and may be identified via a review of prints of the selected reel, wherein if the code is being applied to an interpositive, a suitable scene preferably comprises a scene that is neutral in density (e.g., neither too dark nor too light), wherein if the code is being applied to an internegative, a suitable scene may comprise a neutral exterior shot (e.g., a blue or green colored scene). Out of all of the scene(s) that meet the appropriate criteria, certain scene(s) may then be chosen as desired for coding and according to one aspect of the present invention, it is this selection of specific locations/scenes on a reel for coding that enables a unique code identifier for each laboratory. A laboratory, upon developing its own unique code, may thus use this code on any reels they produce to serve as a source identifier, so that all coded reels produced by that lab may be traced back to it.

Once a reel and chosen locations thereon have been selected from the prints, the intermediate film element is placed onto a reel display apparatus emulsion side up. The reel display apparatus may comprise, e.g., a hand rewind inspection bench including two hand cranked plates and spindles, separated by a footage sprocket counter, a lamp (light) box, and an overhead light. The left hand cranked plate, known as the Feed Plate, is where the negative is placed, and the right hand cranked plate ('take up plate') is where the end of the negative is wrapped over a bobbin and wound on using the crank arm. The film is clamped to the footage counter (which displays how many perforations, frames and feet of negative are passed through during winding of the negative onto the take up plate) and is wound to the first chosen scene (e.g., using the footage counter, the film is wound to "zero" so the footage starts at Picture Start 0000+00). The film is secured (e.g., taped at its edges) to the light box with frames of the chosen scene emulsion-side up (step 105).

A single coat of film stabilizer solution is applied preferably to a plurality (e.g., about 3 or 4) of frames of the scene (step 107). The stabilizer solution may comprise any film stabilizer comprising e.g., a chemical stabilizer and a stabilizer additive in a base of distilled water. For example, in one embodiment the stabilizer may comprise a solution including 0.0155% polyoxethylene with a stabilizer additive (e.g., 1-2 Tridecyl alcohol) in distilled water. Application of the stabilizer solution onto the film is preferably via a cotton swab in clean vertical swipes, and it is preferable to keep the code towards the non-trackside of the film. Advantageously, by applying the code to this non-trackside area, the code would be within the frame of the picture at all times and would be very difficult to displace, e.g., on a telecine or Optical printer. The first coat is allowed to dry (step 109) for a period of time, preferably at least about 60 seconds. Then a second coat of stabilizer solution is applied (step 111) to form double-coated frames.

The coated portion of the film element is wound into the reel preferably while still wet (step 113). In decision step 115, it is ascertained if there is an additional scene to code; if yes, the process returns to step 103 in which a next suitable scene which is desired to be coded is selected. If no, the entire film element is wound onto the reel and stored or 'cured' (step 117). Curing of the coded reel may comprise, e.g., placement in a can (e.g., its original reel receptacle) for a period of time (e.g., at least about 12 hours), or the reel may be placed face down on a light box for a period of time (e.g., at least about 3 hours). Preferably, no other handling of the reel is made during this curing time. After the curing period is completed, the process continues to step 201 of FIG. 2 (step 119).

It is to be noted that during the coding process, it is preferable to take note of the scenes, footages and/or frame counts where the coding has been applied.

In step 201, it is ascertained whether the intermediate film element is an interpositive or an internegative. If interpositive, the interpositive is cleaned (step 203), and an internegative as well as check print are created (step 205). The check print is viewed to verify the coded locations on the reel (step 207). The interpositive is put back onto the reel display apparatus (e.g., the inspection bench), wound to one of its coded areas, and secured (e.g., via taping of its edges) to the light box (step 209).

The coded area is viewed (e.g., under magnification) to check the amount of spread of the stabilizer solution on the emulsion (step 211). That is, it is preferable to check that the spread of the stabilizer is not too wide and does not cover the entirety of the coded frames. Also, it is desirable to keep the stabilizer along the opposite side of the sound track area. Then, a third coat of stabilizer solution is applied evenly across the coded frames and is allowed to dry naturally (step 213). This process is repeated for each of the selected scenes; that is, in decision step 215, it is determined whether there is another scene which is coded and has not yet received a third coat of stabilizer. If yes, return to step 207. If no, the process is done according to one embodiment (step 217). It is to be noted that in other embodiments, additional steps (e.g., application of greater than three coatings of stabilizer) or fewer steps (e.g., less than three coats of stabilizer) may be contemplated.

If it is assessed in step 201 that an internegative element has been used, check prints are created (step 204) and the process proceeds to step 207.

Note that after each application of the stabilizer, the frames should be checked to see that the stabilizer solution has taken (i.e., that the top layer of the emulsion of the negative in the coded areas has swollen sufficiently due to application of the stabilizer so as to alter the uniformity of the emulsion) and has not been contaminated with dirt, dust or other impurities. Preferably, the stabilizer should be applied so that its spread is not too wide and does not cover the entire picture frame. Also, when applying this process to polyester internegatives, care should be taken so that the emulsion is not over wet, as this could lead to de-lamination of the negative.

According to one aspect of the present invention, an intermediate film element (interpositive or internegative) is produced which is security coded (displays visual markings) at specific locations (e.g., desired scenes), while maintaining the integrity of and not harming the film or its qualities in any way. Additionally, while a coding applied according to one embodiment of the present invention is virtually invisible to, e.g., an audience member, during, e.g., playback via a cinema projector, the coding will be indelible and survive such processes as compression with respect to illegally produced digital or video recordings.

In appearance, the security coding or markings may comprise, e.g., streaks or watermarks (in the case of coding of an interpositive) or a light density change or color drop (in the case of a coded internegative). A security code according to the present invention may be applied to, e.g., different locations on a reel or footage by each individual owner of the film (laboratory) so that the code is unique for each specific laboratory. The different codes and footages of their locations and other such data can be logged and saved so that they may be referenced if verification of a code is sought. Accordingly, if illegal copies are made of a coded intermediate element according to the present invention, such pirated copies can be readily identified and traced. For example, the code can identify which country, laboratory or complex the negative was shipped to before the illegal copies were made.

FIG. 3 is an exemplary illustration of what a finished security marking would look like on a print 300 made from a coded negative according to an aspect of the present invention. The resultant print 300 of a negative which is coded according to an aspect of the present invention may display streaks or watermark markings, e.g., as shown.

Although the embodiment which incorporates the teachings of the present invention has been shown and described in detail herein, those skilled in the art can readily devise many other varied embodiments that still incorporate these teachings. Having described preferred embodiments for a system and method for coding an intermediate film element (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

The invention claimed is:

1. A method of coding a film element comprising the steps of:

applying a first coat of a stabilizer solution to frames of a selected scene of a selected reel of a film element to form single coated frames;

applying a second coat of the stabilizer solution to the single-coated frames to form double coated frames; and applying a third coat of the stabilizer solution to the double-coated frames.

2. The method of claim 1, wherein the film element comprises an interpositive.

3. The method of claim 1, wherein the film element comprises an internegative.

4. The method of claim 1, wherein the selected scene comprises a specific location on the selected reel of the film element.

5. The method of claim 1, wherein the stabilizer solution comprises at least a 0.0155% solution of polyoxethylene and a stabilizer additive in distilled water.

6. The method of claim 1, wherein the stabilizer solution is applied to an emulsion side of the film element.

7. The method of claim 1, further comprising the step of drying the single coated frames for at least about 60 seconds.

8. The method of claim 1, further comprising the steps of storing the reel in a container, and curing the reel for at least 12 hours.

9. The method of claim 1, further comprising the step of placing the reel on a light box, curing the reel for at least 3 hours.

10. The method of claim 1, further comprising the step of drying the frames following the step of applying the third coat of the stabilizer.

11. A method of coding a film element comprising the steps of:

selecting a suitable reel of the film element to be coded;

selecting a suitable and desired location in said selected reel to be coded;

applying a first coat of a stabilizer solution to frames of the selected location;

applying a second coat of the stabilizer solution to the frames; and applying a third coat of the stabilizer solution to the frames.

12. The method of claim 11, wherein the film element comprises an interpositive.

13. The method of claim 11, wherein the film element comprises an internegative.

14. The method of claim 11, wherein the stabilizer solution comprises at least a 0.0155% solution of polyoxethylene and a stabilizer additive in distilled water.

15. The method of claim 11, wherein the stabilizer solution is applied to an emulsion side of the film element.

16. The method of claim 11, further comprising the step drying the frames for at least 60 seconds.

17. The method of claim 11, further comprising the step of storing the reel in a container, and curing the reel at least 12 hours.

18. The method of claim 11, further comprising the step of placing the reel on a light box, and curing the reel at least 3 hours.

19. The method of claim 11, further comprising the step of drying the frames following the step of applying the third coat of the stabilizer.

* * * * *